US005152262A

United States Patent [19]

Parker

[11] Patent Number: 5,152,262

[45] Date of Patent: Oct. 6, 1992

[54] INTERNAL COMBUSTION ENGINE CAMSHAFT DRIVE MECHANISM

[75] Inventor: Peter H. Parker, Redditch, England

[73] Assignee: Rover Group Limited, England

[21] Appl. No.: 595,431

[22] Filed: Oct. 11, 1990

[30] Foreign Application Priority Data

Oct. 13, 1989 [GB] United Kingdom ..... 8923181

[51] Int. Cl.[5] ..... F01L 1/34

[52] U.S. Cl. ..... 123/90.17; 123/90.31

[58] Field of Search ..... 123/90.15, 90.17, 90.31

[56] References Cited

U.S. PATENT DOCUMENTS

| | | | |
|---|---|---|---|
| 862,448 | 8/1907 | Cornilleau | 123/90.17 |
| 4,395,980 | 8/1983 | Tominaga et al. | 123/90.27 |
| 4,723,517 | 2/1988 | Frost . | |

FOREIGN PATENT DOCUMENTS

| | | |
|---|---|---|
| 0234845 | 9/1987 | European Pat. Off. . |
| 3842283 | 6/1990 | Fed. Rep. of Germany . |
| 464016 | 4/1937 | United Kingdom . |
| 1666828 | 10/1969 | United Kingdom . |
| 1311562 | 6/1970 | United Kingdom . |
| 1202128 | 8/1970 | United Kingdom . |
| 1289580 | 8/1970 | United Kingdom . |
| 1228283 | 4/1971 | United Kingdom . |
| 1399351 | 7/1975 | United Kingdom . |
| 1522405 | 4/1976 | United Kingdom . |
| 2066361 | 12/1980 | United Kingdom . |
| 1604605 | 12/1981 | United Kingdom . |
| 2096695 | 10/1982 | United Kingdom . |
| 2128679 | 5/1984 | United Kingdom . |
| 2133465 | 7/1984 | United Kingdom . |
| 2162243 | 1/1986 | United Kingdom . |
| 2165885 | 4/1986 | United Kingdom . |
| 2166842 | 5/1986 | United Kingdom . |
| 2202002 | 9/1988 | United Kingdom . |
| 88/08919 | 11/1988 | World Int. Prop. O. . |

OTHER PUBLICATIONS

U. K. Pat. Application GB 2165885A Inventor: Atkin, published Apr. 23, 1986.

SAE Technical Paper Series 880386 "A Review of Variable Engine Valve Timing", by C. Gray, International Congress and Exposition, Detroit, Mich., Feb. 29-Mar. 4, 1988.

FISITA Paper B-1-11 (1974), "A Camshaft with Variable Lift—Rotation Characteristics; Theoretical Properties and Application to the Valve Gear of a Multicylinder Piston Engine", by D. A. Parker et al.

"British Lead in Future Developments":—Article in The Journal of Automotive Engineering, Dec. 1974, pp. 28-29, by Ken Garrett.

"Variable Valve Timing for ic Engines"—Article in Automotive Engineer, Aug./Sep. 1985, pp. 54-58.

*Primary Examiner*—Noah P. Kamen

*Attorney, Agent, or Firm*—Davis, Bujold & Streck

[57] ABSTRACT

A camshaft drive mechanism operates the inlet valves of a first cylinder through a variable valve timing (VVT) mechanism at one end of an engine block and the inlet valves of a second cylinder through a VVT mechanism at the other end of the block. In a four cylinder engine the first cylinder is No 1 and the second cylinder is No 4, cylinders Nos 2 and 3 having separate VVT mechanisms adjacent the VVT mechanisms of cylinders Nos 1 and 4 respectively. A preferred form of VVT mechanism includes an eccentric sleeve which provides a journal for a driving member. Rotation of the eccentric sleeve in an offset bore alters the valve timing. By having the offset equal to the eccentricity of the sleeve the potential wear of the components of the VVT mechanism is reduced.

31 Claims, 8 Drawing Sheets

INTERNAL COMBUSTION ENGINE CAMSHAFT DRIVE MECHANISM

The invention relates to internal combusion engines and in particular to the camshaft drive mechanisms of such engines.

BACKGROUND OF THE INVENTION

Camshaft drive mechanisms which incorporate variable valve timing (VVT) are known. The benefits in terms of engine performance are discussed in SAE Technical Paper Series 880386 entitled "A Review of Variable Engine Valve Timing" by C Gray which also discusses various variable valve timing mechanisms.

One type of VVT mechanism which gives a very large scope for improving engine performance varies the timing of both the opening and the closing of the valves by cyclic variation of the rotational speed of the cams during otherwise constant rotational speed of the engine crankshaft.

In applying this type of VVT mechanism to an engine with two or more cylinders there arises a problem of installation since the valve timing of each cylinder is at a different phase of the cyclic variation at any one time.

GB-A-1522405 illustrates the installation problem in a four cylinder in-line engine where a VVT mechanism is installed between No 2 cylinder and No 3 cylinder. Here the installation is made practicable by the engine being of a type commonly used in large motorcycles where the engine drive output is from a gear wheel on the crankshaft between cylinders No 2 and 3. A conventional four cylinder engine for cars or automobiles takes the engine drive output from one end of the crankshaft and it becomes impracticable to increase the length of the engine by installing a camshaft drive and VVT mechanism between cylinders Nos 2 and 3.

GB-A-1522405 illustrates a known VVT mechanism where the notionally constant rotational speed of a driving member produces a cyclic variation in the speed of a camshaft by moving the axis of rotation of the driving member relative to the axis of rotation of an output member on the camshaft. A drive mechanism transmits drive between the driving member and the output member. In GB-A-1522405 this drive mechanism comprises a drive peg on the output member which engages a slot in the driving member. U.S. Pat. No. 4,723,517 illustrates a VVT mechanism of the same general type but where the drive mechanism comprises a slide driven through a slot and tongue connection by the driving member and having rack teeth which engage gear teeth on the camshaft.

GB-A-1311562 overcomes the problem of providing a rotary drive to a driving member whose axis of rotation has to be moved by providing an input member which is coaxial with the output member and drives the driving member through a peg which engages a further slot in the driving member. The notionally constant rotational speed of the input member produces a cyclic variation in the rotational speed of the camshaft by moving the axis of rotation of the driving member. Although two methods of moving the driving member are shown, neither method approaches the optimum control of valve timing required to give good low speed performance and low exhaust emissions at idle or tick-over combined with high power at higher engine speeds.

SUMMARY OF THE INVENTION

It is an object of the invention to overcome the abovementioned disadvantages.

According to one aspect of the invention there is provided a camshaft drive mechanism for an internal combustion engine having an engine block which defines at least first and second cylinders arranged in line, a first group of valves comprising the inlet valves for each cylinder and a second group of valves comprising the exhaust valves for each cylinder and a crankshaft, the camshaft drive mechanism comprising first and second camshafts extending parallel to the crankshaft for operating one of said groups of valves for the first and second cylinders respectively, a first variable valve timing (VVT) mechanism at one end of the engine drivingly connected to the first camshaft and arranged to be driven by the crankshaft and a second VVT mechanism drivingly connected to the second camshaft and arranged to be driven by the crankshaft, wherein the first VVT mechanism is adjacent one end of the engine block and the second VVT mechanism is adjacent the other end of the engine block.

In its said one aspect the invention is applicable to two cylinder engines and to engines with two or more banks of two cylinders, for example V4 engines. In a preferred arrangement a layshaft extends parallel to said first and second camshafts, first drive means adjacent said one end of the engine block being provided for transmitting drive from the crankshaft to the first VVT mechanism and to the layshaft and second drive means adjacent said other end of the engine block being provided for transmitting drive from the layshaft to the second VVT mechanism.

Conveniently, said first and second camshafts are the inlet camshafts and the layshaft comprises an exhaust camshaft for operating the exhaust valves. Alternatively a separate layshaft may be used, particularly in a V type engine where the layshaft may be situated between the banks of cylinders. This allows both inlet and exhaust valves to have VVT mechanisms.

A third camshaft having an elongate portion extending coaxially through the first camshaft may be arranged to operate a valve of said one group for a third cylinder interposed between the first and second cylinders, a third VVT mechanism adjacent the first VVT mechanism being drivingly connected to the third camshaft through the elongate portion and to the crankshaft. Similarly a fourth camshaft having an elongate portion extending coaxially through the second camshaft may be arranged to operate a valve of said one group for a fourth cylinder interposed between the third and second cylinders, a fourth VVT mechanism adjacent the second VVT mechanism being drivingly connected to the fourth camshaft through the elongate portion and to the crankshaft. Thus in a bank of three cylinders, conventionally referred to as cylinders Nos 1, 2 and 3, the inlet or exhaust valves of cylinders Nos 1 and 2 are operated through the first and third VVT mechanisms grouped adjacent one end of the bank and the inlet or exhaust valve or valves of cylinder no 3 are operated through the second VVT mechanism adjacent the other end of the bank. A bank of four cylinders is similarly served, the inlet or exhaust valves of cylinder no 3 being operated through the fourth VVT mechanism and the inlet or exhaust valves of No 4 cylinder being operated through the adjacent second VVT mechanism. The banks of 3 or 4 cylinders may be in an in-line engine or may be part of a V6 or V8 engine with the layshaft drive to the second or fourth VVT mechanisms as previously referred to.

Each VVT mechanism may comprise a respective rotatable driving member arranged to be driven by the crankshaft and a respective output member arranged to drive the respective camshaft, each driving member having an axis of rotation which is movable relative to the axis of rotation of the respective output member to vary the valve timing.

In each VVT mechanism the driving member may be journalled in an eccentric sleeve which is rotatable in a bore in the engine block to vary the valve timing. Preferably the axis of the bore is offset from the axis of rotation of the respective output member, in which case the offset is preferably equal to the eccentricity of the sleeve.

Where there are two adjacent VVT mechanisms, as is the case of the bank of three or four cylinders, the eccentric sleeve may be common to the two adjacent VVT mechanisms.

The eccentric sleeve may be driven by a servomotor, preferably through a non-reversible worm and worm wheel gear drive. Hence torque from the servomotor is only required when adjustment of the eccentric sleeve position is needed.

Each eccentric sleeve may have gear teeth to mesh with a control shaft which extends along the engine block and has a worm wheel for meshing with a worm driven by the servomotor.

Conveniently a first input member is rotatable about substantially the same axis as the first output member and is arranged to transmit drive to the first driving member and a second input member is rotatable about substantially the same axis as the second output member and is arranged to transmit drive to the second driving member. Where there are three or four cylinders in a bank an input member may be common to an adjacent pair of VVT mechanisms.

Each VVT mechanism may comprise a peg on the respective input member and a peg on the respective output member, each driving member defining a pair of diametrically opposed radial grooves each for driving engagement with a respective one of the pegs.

Where there are three or four cylinders in a bank the output member of the third VVT mechanism may extend through the driving member of the first VVT mechanism and, where appropriate, the output member of the fourth VVT mechanism may extend through the driving member of the second VVT mechanism.

Conveniently, each output member is on the respective inlet camshaft and, where appropriate, the output members of the third and fourth VVT mechanisms may comprise the elongate portions of the third and fourth camshafts respectively.

Thus the invention provides a novel camshaft drive mechanism which avoids the installation problems associated with VVT in multi cylinder engines.

However, the invention also provides a form of VVT mechanism with improved operational characteristics and according to another aspect of the invention there is provided a camshaft drive mechanism for an internal combustion engine having an engine block which defines at least one cylinder, inlet and exhaust valves for the cylinder and a crankshaft, the camshaft drive mechanism comprising an inlet camshaft for operating one of said valves of the cylinder and a VVT mechanism drivingly connecting the crankshaft to the camshaft and comprising a rotatable driving member drivingly connected to the crankshaft, an output member arranged to drive the camshaft and an eccentric sleeve providing a journal for the driving member and being rotatable in a bore in the engine block, wherein the axis of rotation of the eccentric sleeve is offset from the axis of rotation of the output member. Preferably the offset is substantially equal to the eccentricity of the eccentric sleeve, in which case the axis of rotation of the output member may substantially coincide with the axis of rotation of the output member at one operational position of the eccentric sleeve.

An input member may be rotatable about substantially the same axis as the output member and arranged to be driven by the crankshaft and to transmit drive to the driving member. Conveniently a peg on the input member and a peg on the output member are each in driving engagement with a respective one of a pair of diametrically opposed radially extending grooves in the driving member. The output member may be on the camshaft.

It is known from GB-A-1522405 and U.S. Pat. No. 4,723,517 to provide a camshaft drive mechanism including a pair of VVT mechanisms driving a pair of nested camshafts, that is one camshaft having an elongate portion extending coaxially through the other camshaft. However, the known mechanisms require guided lateral or arcuate movement of a gearwheel, sprocket or pulley wheel in the drive from the crankshaft to the camshaft with consequent complication.

Thus according to a further aspect of the invention there is provided a camshaft drive mechanism for an internal combustion engine having an engine block which defines at least first and second cylinders arranged in line, a first group of valves comprising the inlet valves for each cylinder and a second group of valves comprising the exhaust valves for each cylinder and a crankshaft, the camshaft drive mechanism comprising first and second camshafts extending parallel to the crankshaft for operating one of said groups of valves for the first and second cylinders respectively, the second camshaft having an elongate portion extending coaxially through the first camshaft, a first VVT mechanism arranged to transmit drive from the crankshaft to the first camshaft and a second VVT mechanism arranged to transmit drive from the crankshaft to the second camshaft through the elongate portion, each VVT mechanism comprising a rotatable driving member arranged to be driven by the crankshaft and an output member arranged to drive the respective camshaft and rotatable about a common axis of rotation, each driving member having an axis of rotation which is movable relative to the axis of rotation of the output members to vary the valve timing, wherein each driving member is journalled in an eccentric sleeve which is rotatable in a bore in the engine block to vary the valve timing.

Preferably the axis of each bore is offset from the axis of rotation of the output members, in which case the offset may be substantially equal to the eccentricity of the sleeve.

The eccentric sleeve may be common to the first and second VVT mechanisms.

Preferably an input member is rotatable about substantially the same axis as the output members and is arranged to be driven by the crankshaft and to transmit drive to the driving members. Each VVT mechanism may comprise a respective one of a pair of pegs on the input member and a peg on the respective output member, each driving member defining a pair of diametrically opposed radial grooves each for driving engagement with a respective one of the pegs. The output member of the second VVT mechanism may extend through the driving member of the first VVT mechanism and the input member of the first VVT mechanism may extend through an aperture in the driving member of the second VVT mechanism.

Conveniently each output member is on the respective camshaft, in which case the driving member of the second VVT mechanism may comprise the elongate portion of the second camshaft.

BRIEF DESCRIPTION OF THE DRAWINGS

The invention will now be described with reference to the accompanying drawings, of which.

DESCRIPTION OF THE PREFERRED EMBODIMENT

Figure 1:
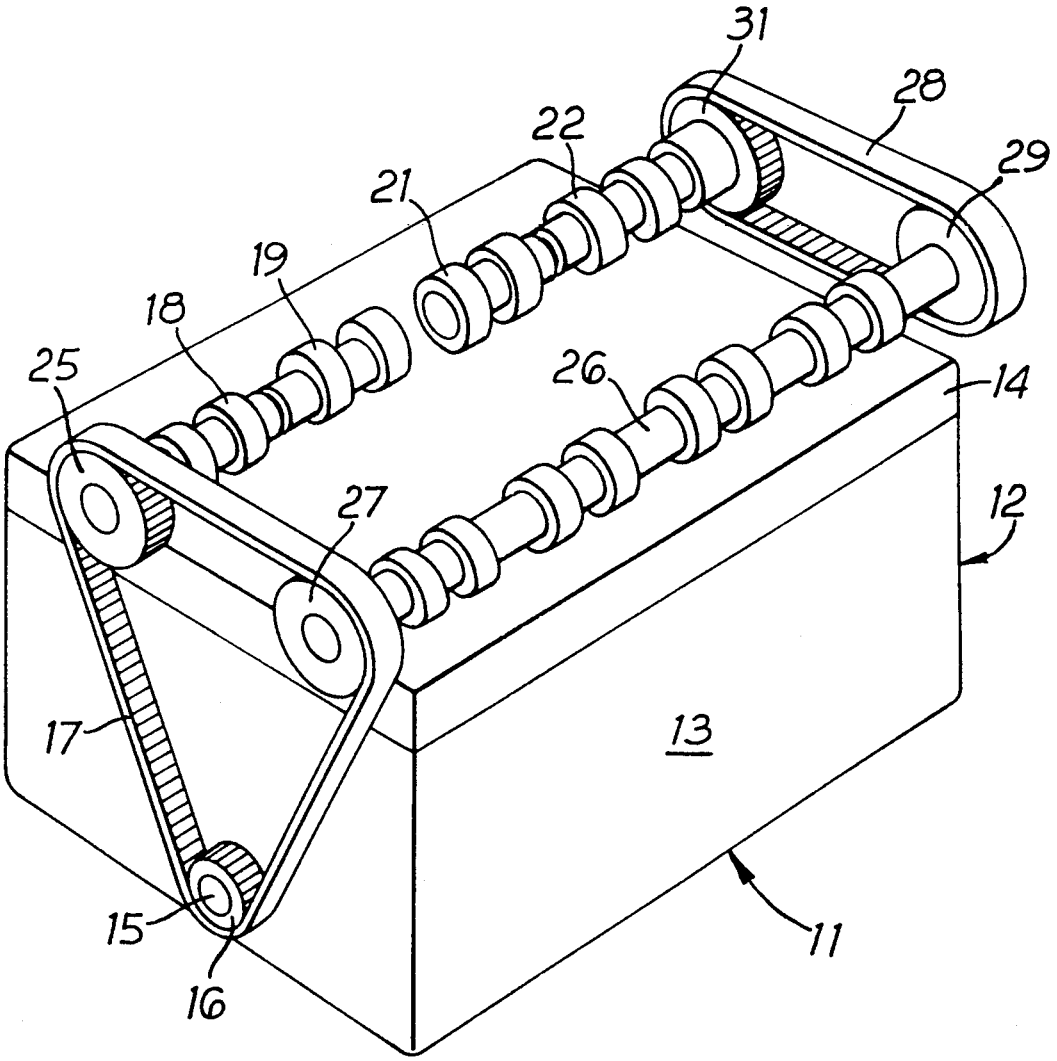
FIG. 1 is a diagrammatic perspective view of an internal combustion engine incorporating one embodiment of a camshaft drive mechanism according to the invention.

Referring to FIGS. 1 to 4 and in particular to FIG. 1, an internal combustion engine 11 includes an engine block 12 comprising a crankcase 13 integral with a cylinder block having a bank of four cylinders in line and a cylinder head 14. A crankshaft 15 is journalled in the crankcase and has a drive pulley 16 for a toothed belt 17.

The crankshaft 15 carries a flywheel (not shown) at its end remote from the drive pulley 16 for transmitting the engine output, eg through a clutch to a gearbox. In the conventional manner the cylinders will be referred to as Nos 1 to 4, starting at the drive pully end.

The cylinder head 14 carries inlet and exhaust valves (not shown) for the engine. The inlet valves are operated by four inlet camshafts 18, 19, 21 and 22 for cylinder Nos 1, 2, 3 and 4 respectively. The inlet camshafts 18 and 19 of cylinders Nos 1 and 2 are nested, that is inlet camshaft 19 has an elongate portion 23 which extends coaxially through a bore 24 in inlet camshaft 18. Inlet camshafts 18 and 19 are both driven by a toothed pulley 25.

An exhaust camshaft 26 extending parallel to the inlet camshafts 18, 19, 20 and 21 is common to all four cylinders and is driven by another toothed pulley 27, pulleys 25 and 27 being driven by the toothed belt 17 and having twice the number of teeth as the drive pulley 16 so as to rotate at half crankshaft speed. The exhaust camshaft 26 acts as a layshaft to transmit drive through another toothed belt 28 and through another pair of pulleys 29 and 31 to the inlet camshafts 21 and 23 of cylinders Nos 3 and 4, pulley 31 having the same number of teeth as pulley 29.

The inlet camshafts 21 and 23 of cylinders Nos 3 and 4 are also nested in the same manner as inlet camshafts 18 and 19.

Figure 2A:
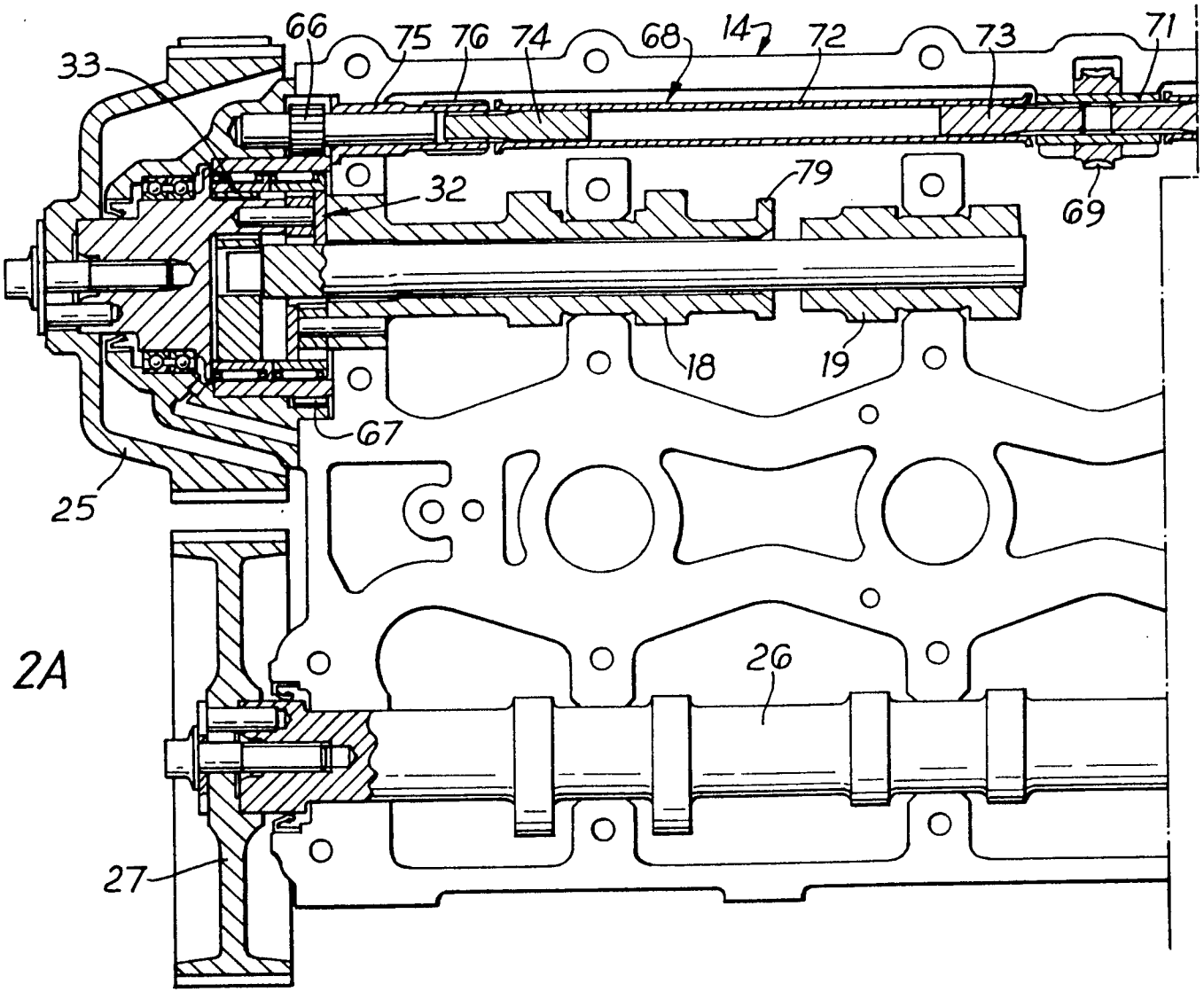
FIG. 2A and 2B are respectively right and left hand portions of a plan view of the cylinder head of the engine shown in FIG. 1 showing parts of the camshaft drive mechanism in more detail.
Figure 2B:
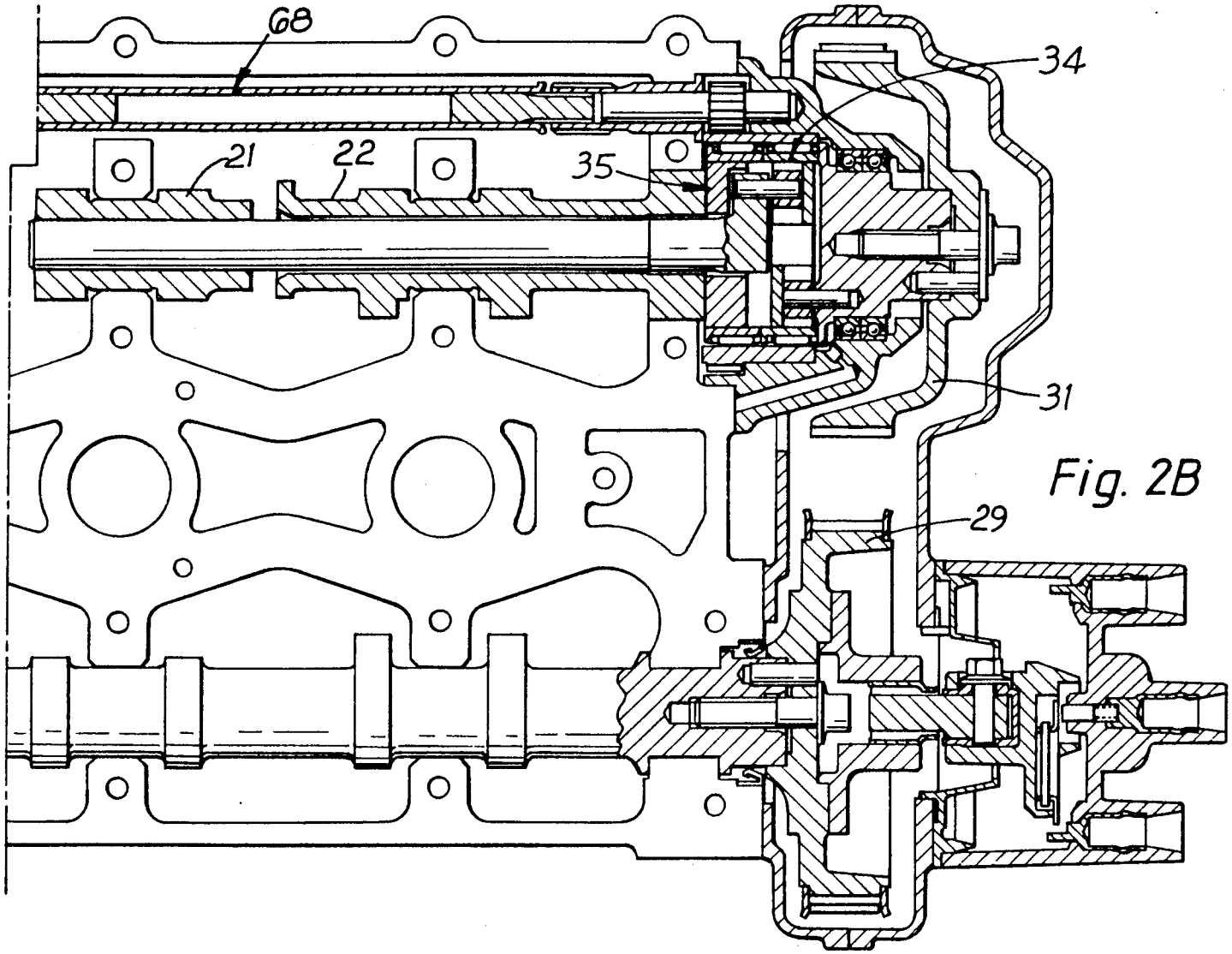

Each of the inlet camshafts 18, 19, 21 and 22 is driven through a respective variable valve timing (VVT) mechanism, indicated generally at 32, 33, 34 and 35 respectively (FIGS. 2A and 2B). The VVT mechanisms for cylinders Nos 1 and 2 are grouped together adjacent one end of the engine block 12 where they are driven by first drive means comprising the drive pulley 16 and toothed belt 17 adjacent the same end and the VVT mechanisms for cylinders Nos 3 and 4 are grouped together adjacent the other end of the engine block where they are driven by second drive means comprising pulleys 29 and 31 and toothed belt 28.

Figure 3:
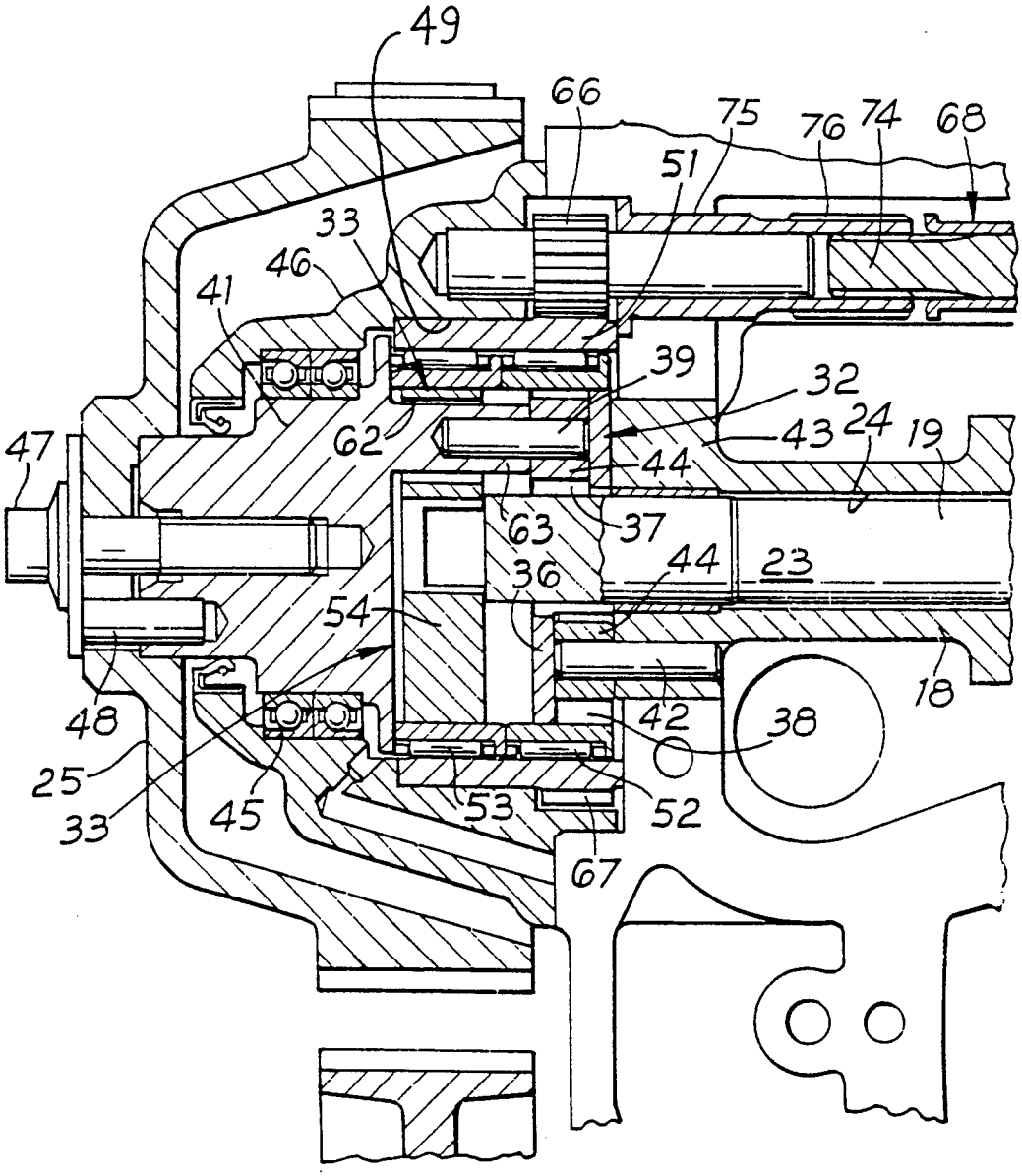
FIG. 3 is an enlarged view of part of the camshaft drive mechanism shown in FIG. 2.
Figure 4:
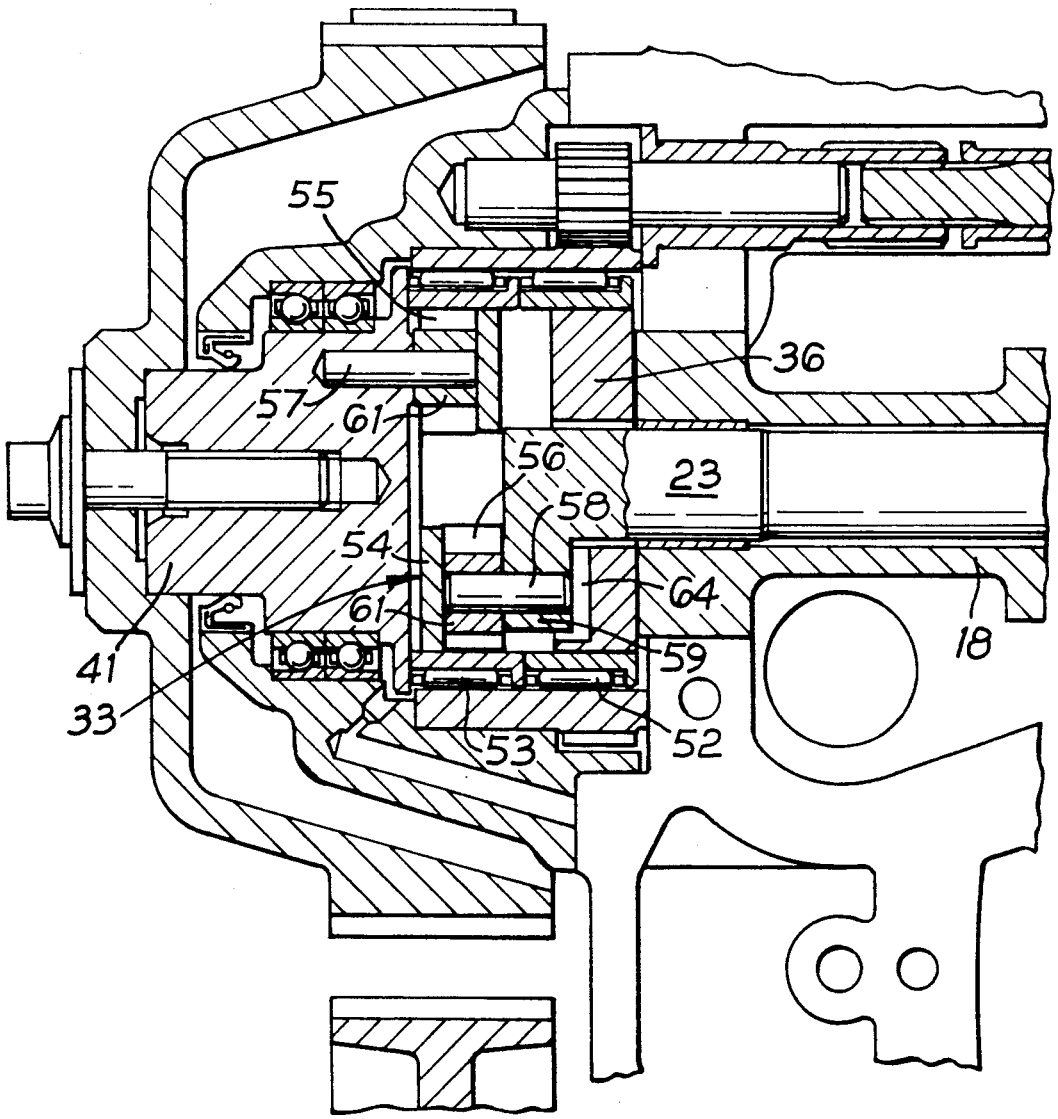
FIG. 4 is a view similar to FIG. 3 showing the camshaft drive mechanism rotated through 90 degrees.

Since the VVT mechanisms 32 and 33 for cylinders Nos 1 and 2 are essentially similar to the VVT mechanisms for cylinders Nos 3 and 4 it will be convenient to describe only the VVT mechanisms 32 and 33 of cylinders Nos 1 and 2 in detail and with particular reference to FIGS. 3 and 4. FIG. 3 shows the details of the VVT mechanism 32 of cylinder No 1 to better effect whereas FIG. 4 shows the details of the VVT mechanism 33 of cylinder No 2 to better effect.

VVT mechanism 32 includes a driving member 36 which defines a pair of diametrically opposed radially extending grooves 37 and 38 of rectangular section.

Groove 37 is in driving engagement with a peg 39 on an input member 41 and groove 38 is in driving engagement with a peg 42 on an output member in the form of a bearing portion 43 of the inlet camshaft 18 of No 1 cylinder. The pegs 39 and 42 drive through rectangular drive blocks 44 each of which is rotatable on its respective peg 39 or 42 and is a close sliding fit in its respective groove 37 or 38.

The input member 41 is rotatable about substantially the same axis as the camshafts 18 and 19, being carried by ball bearings 45 in a housing 46 attached to the cylinder head 14. Pulley 25 is spigotted onto the input member 41 and is retained by a cap screw 47. A peg 48 engages a slot in the pulley 25 to transmit drive and provide an angular location.

The housing 46 forms part of the engine block 12 and defines a bore 49 whose axis is offset from the axis of rotation of the inlet camshafts 18, 19, 21 and 23. An eccentric sleeve 51 is rotatable in the bore 49 and provides the outer races of a pair of needle roller bearings 52 and 53. The inner race of bearing 52 is a press fit on the outer diameter of driving member 36 so that the driving member is journalled in the eccentric sleeve 51.

VVT mechanism 33 includes a driving member 54 which defines a pair of diametrically opposed radially extending grooves 55 and 56 of rectangular section. Groove 55 is in driving engagement with another peg 57 on the input member 41 and groove 56 is in driving engagement with a peg 58 on an output member in the form of a radially extending lobe 59 which is part of the elongate portion 23 of the inlet camshaft 19 of cylinder No 2. The pegs 57 and 58 drive through rectangular drive blocks 61 in a similar manner to pegs 39 and 42.

The inner race of bearing 53 is a press fit on the outer diameter of driving member 54 so that the driving member 54 is journalled in the eccentric sleeve 51 which is thus common to the adjacent VVT mechanisms 32 and 33.

Figure 5:
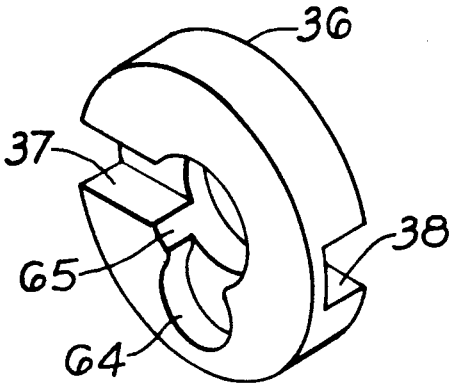
FIG. 5 is a perspective view of one of the components shown in FIGS. 3 and 4.

The driving member 54 of the VVT mechanism 33 has an aperture 62 angularly spaced from the grooves 37 and 38 to allow a boss 63 on the input member 41 to extend through with clearance, the boss 63 being drilled to receive the peg 39. To minimize the overall length of the adjacent VVT mechanisms 32 and 33 and to keep the length of the boss 63 to a minimum, a recess 64 in the driving member 36 is provided to partially accommodate the lobe 59 with clearance. FIG. 5 shows the driving member 36 in detail perspective and also shows an axial bore 65 which provides a clearance aperture through which the elongate portion 23 of the inlet camshaft 19 extends.

Each VVT mechanism 32, 33, 34 and 35 produces a cyclic variation in the speed of the respective camshaft by moving the axis of rotation of the respective driving member relative to the axis of rotation of the output member on the camshaft. This is achieved by rotating the eccentric sleeve 51 which is shown in more detail and on an enlarged scale in FIG. 6. The outer diameter of the sleeve 51 which rotates in the bore 49 is represented by D1 and the inner diameter which provides the outer race of the needle roller bearings 52 and 53 is represented by D2. The eccentricity of the sleeve is represented by E and this dimension is made substantially equal to the offset between the axis of rotation of the inlet camshafts 18, 19, 21 and 22 and the axis of the bore 49 in the housing 46.

Rotary control of the eccentric sleeve 51 is achieved by rotation of a gear pinion 66 which meshes with gear teeth 67 on the outer periphery of the eccentric sleeve. The pinion 66 is part of a control shaft 68 which extends from one end of the cylinder head 14 to the other and also includes a worm wheel 69 on a hollow shaft 71. Another hollow shaft 72 has splined end pieces 73 and 74, one end piece 73 connecting with hollow shaft 71 and the other end piece 74 connecting with another hollow shaft 75 which carries the pinion 66 and has skew gear teeth 76 for meshing with a skew gear on a feedback potentiometer (not shown).

Figure 7:
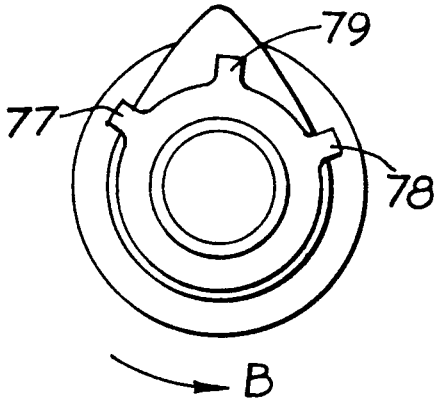
FIG. 7 is an elevation of part of the camshaft drive mechanism shown in FIG. 2A.

A rotary servomotor (not shown) has a worm which meshes with the worm wheel 69 to rotate the control shaft 68 and hence the eccentric sleeve 51, the position of the eccentric sleeve being determined from the feedback potentiometer. A further means of feedback of the position of the eccentric sleeve is provided by three teeth 77, 78 and 79 on the inlet camshaft 18. With the camshaft 18 rotating in the direction of arrow B (FIG. 7), the leading edge of tooth 77 represents the start of the opening of the inlet valves and the leading edge of tooth 78 represents the end of the closing of the inlet valves. The leading edge of tooth 79 represents the angle of maximum lift of the cam.

An inductive transducer (not shown) senses the movement of the teeth 77, 78 and 79 and provides signals for a control system used to operate the servomotor. The signals from teeth 77 and 78 indicate the inlet valve opening period and the signal from tooth 79 is used as a control check to ensure correct operation during rapid engine acceleration.

Figure 8:
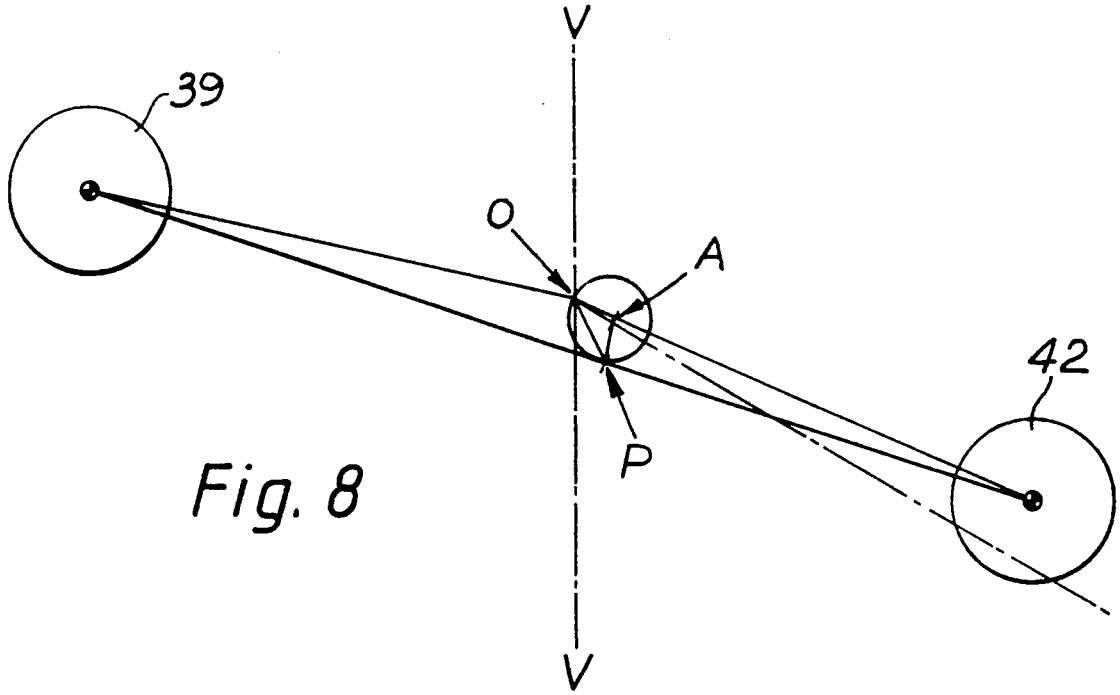
FIG. 8 is a diagram showing on an enlarged scale the geometry of a VVT mechanism incorporated in the camshaft drive mechanism shown in FIGS. 1 to 7.
Figure 9:
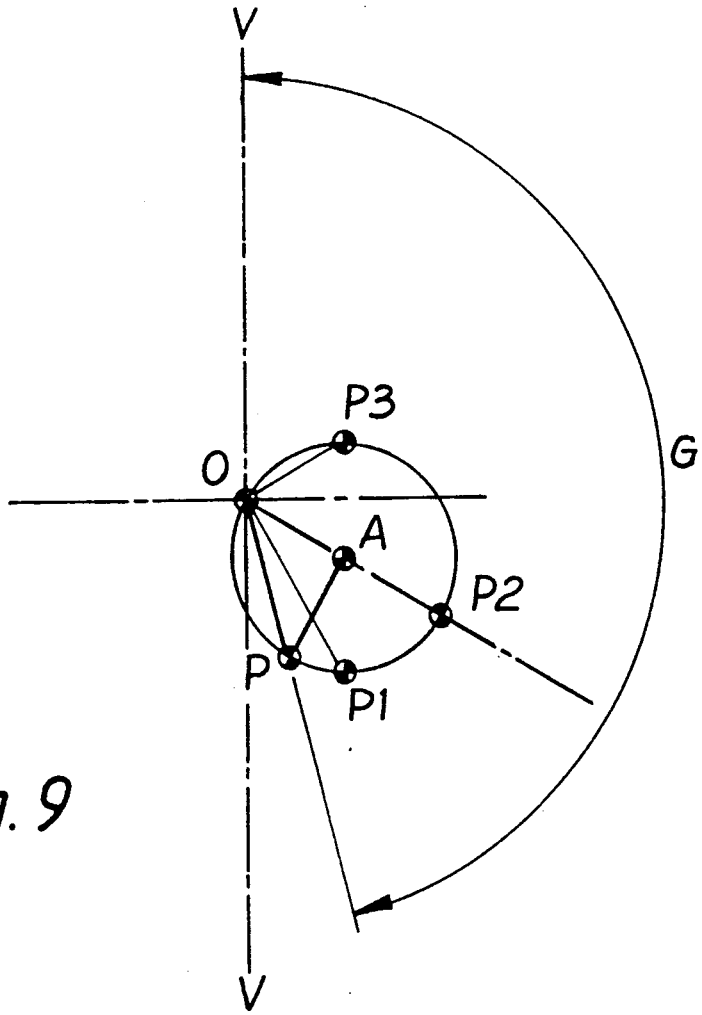
FIG. 9 is a diagram showing part of FIG. 8 on a further enlarged scale and with further detail.

The effect of rotating the eccentric sleeve is shown in FIGS. 8 and 9. In FIG. 8 the pegs 39 and 42 of the VVT mechanism of cylinder No. 1 are shown diagrammatically and the line of motion of the inlet valves is indicated by a line V—V. Point O corresponds to the axis of rotation of the input member 41 and the inlet camshaft 18 and point P corresponds to the axis of rotation of the driving member 36.

Figure 6:
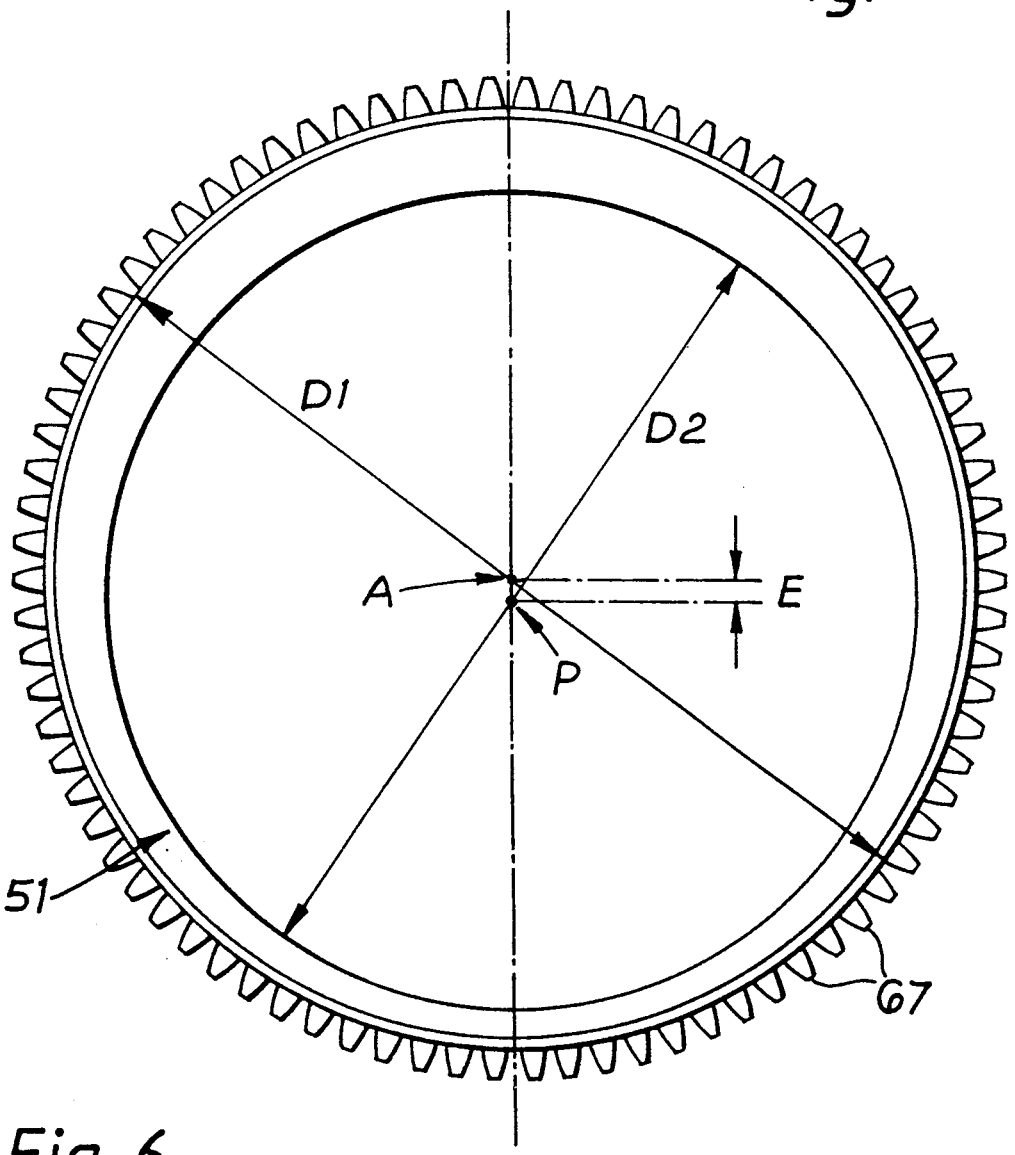
FIG. 6 is an elevation of another of the components shown in FIGS. 3 and 4.

The dimension O-P is conveniently referred to as the eccentricity of the driving member 36 for a particular setting of the eccentric sleeve 51 but is to be distinguished from the eccentricity of the eccentric sleeve which is represented as dimension P-A where A is the axis of the bore 49 in which the eccentric sleeve rotates. Points P and A are also shown in FIG. 6.

The effect of varying the angular position of the eccentric sleeve 51 is to be seen in FIG. 9. When the sleeve is rotated to bring point P coincident with point O then the axis of rotation the input member 41, the camshaft 18 and the driving member 36 all coincide and the drive from the input member to the camshaft is without any cyclic variation.

When the eccentric sleeve 51 is moved such that P is at point P2 the eccentricity O-P is at a maximum.

Figure 10:
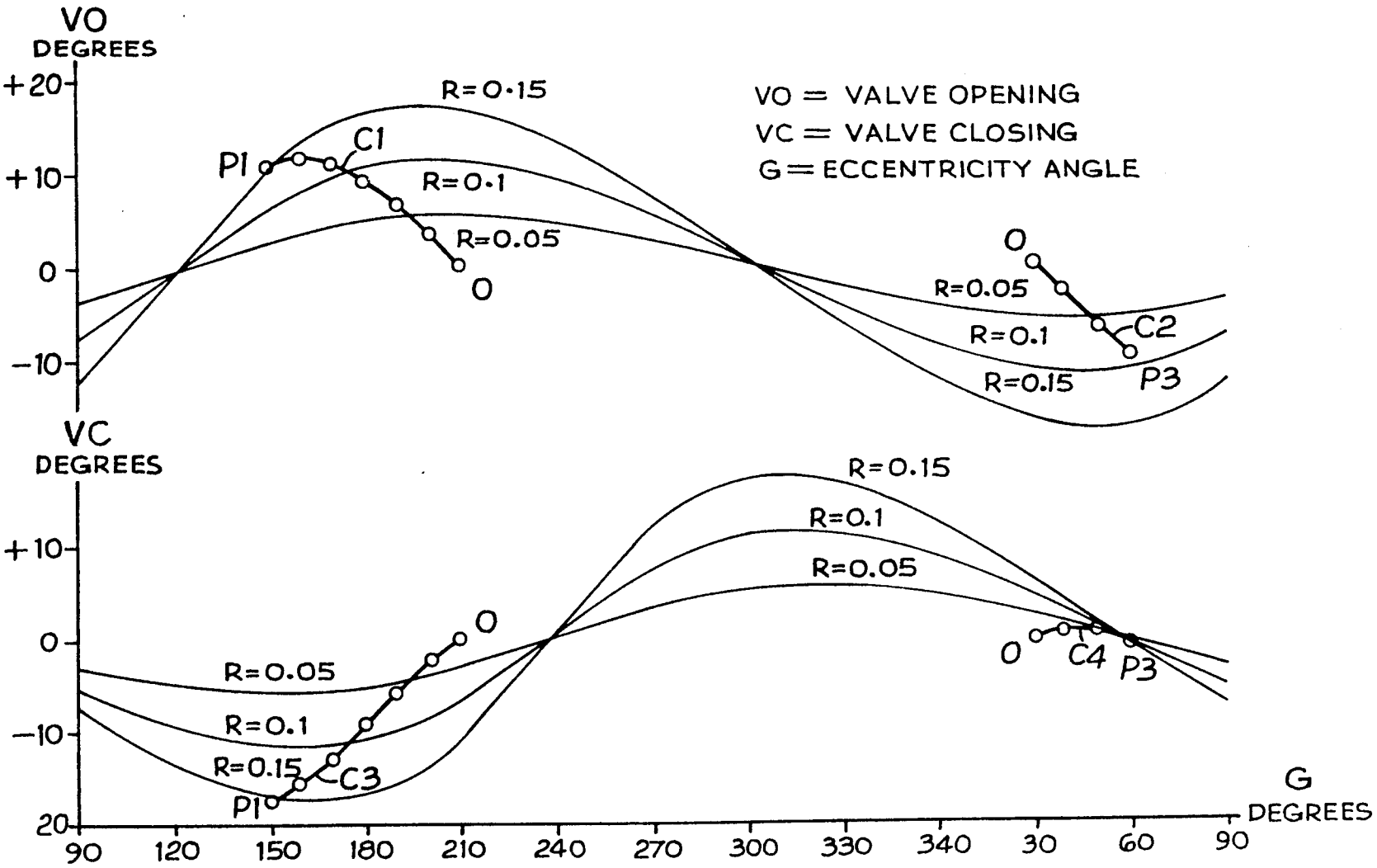
FIG. 10 is a graph illustrating the variation in valve timing obtained using the VVT mechanism incorporated in FIGS. 1 to 7.

Taking the inlet valve motion line V—V as a datum, the angle which O-P makes from the datum can be referred to as the eccentricity angle G. FIG. 10 shows how the inlet cam opening and closing point is advanced or retarded with variations in the eccentricity angle G. The curves show the variation of valve opening angle VO and curves of valve closing angle VC plotted against the eccentricity angle G for various values of the eccentricity OP expressed in a non-dimensional form as the eccentricity ratio R. The eccentricity ratio R is the ratio of the eccentricity O-P to the radial distance between the axis of rotation of the camshaft 18 (point O) and the centre of each of the drive pegs 39 and 42.

Also shown in FIG. 10 are control law curves C1, C2, C3 and C4 which intersect the curves of valve opening and valve closing angle. These control law curves are a characteristic of the invention and result from the axis of rotation of the eccentric sleeve 51 being offset from the axis of rotation of the output member comprising the bearing portion 43 on the inlet camshaft 18. The control law curves C1 and C2 are in effect continuous as are curves C3 and C4. The 180 degree jump (from 210° to 30° ) represents the change from advancing the valve opening to retarding it.

Points P1, O and P2 are shown on the control law curves. Thus at the eccentric sleeve position P1 the inlet valve opening is advanced and the valve closing is retarded. At position O there is no advance or retard of opening or closing and the inlet valve operates according to the basic characteristic of the inlet cam. At point P3 the valve opening is retarded whereas the closing point remains close to the basic cam characteristic.

Position P1 represents the requirement for high power at high engine speeds and P3 represents the requirement for efficient engine running at idle or tickover.

Position O can be chosen to correspond to a medium power output and engine speed, for example main road cruising and, because there is no movement of the drive blocks 44 in the grooves 37 and 38 at this position, wear of the VVT mechanism is minimised.

Although the invention has been particularly described with reference to a four cylinder in line engine it is readily, adapted to other engine configurations as previously discussed. For a bank of three cylinders the VVT mechanism 34 of cylinder No. 3 would be deleted and cylinder No. 4 becomes cylinder No. 3. For a bank of two cylinders the VVT mechanisms 34 and 35 of cylinders Nos. 3 and 4 would be deleted. Alternatively, the VVT mechanisms 33 and 34 of cylinders Nos. 2 and 3 could be deleted and cylinder No. 4 becomes cylinder No. 3.

I claim:

1. In an internal combustion engine having an engine block which defines at least first and second cylinders arranged in line, a first group of valves comprising the inlet valves for each cylinder and a second group of valves comprising the exhaust valves for each cylinder and a crankshaft, a camshaft drive mechanism comprising:

first and second camshafts extending parallel to the crankshaft for operating one of said groups of valves for the first and second cylinders respectively;

a first variable valve timing mechanism adjacent one end of the engine block drivingly connected to the first camshaft and arranged to be driven by the crankshaft;

a second variable valve timing mechanism adjacent the other end of the engine block drivingly connected to the second camshaft and arranged to be driven by the crankshaft;

a layshaft which extends parallel to the camshafts;

first drive means adjacent said one end of the engine block for transmitting drive from the crankshaft to the first variable valve timing mechanism and to the layshaft; and second drive means adjacent said other end of the engine for transmitting drive from the layshaft to the second variable valve timing mechanism.

2. The camshaft drive mechanism of claim 1 wherein the first and second camshafts are the inlet camshafts and the layshaft comprises an exhaust camshaft for operating the exhaust valves.

3. The camshaft drive mechanism of claim 2 further comprising:

a third camshaft having an elongate portion extending coaxially through the first camshaft and arranged to operate a valve of said one group for a third cylinder interposed between the first and second cylinders; and a third variable valve timing mechanism adjacent the first variable valve timing mechanism and drivingly connected to the third camshaft through said elongate portion, the first drive means being operative to transmit drive from the crankshaft to the third variable valve timing mechanism.

4. The camshaft drive mechanism of claim 3 and further comprising:

a fourth camshaft having an elongate portion extending coaxially through the second camshaft and arranged to operate a valve of said one group for a fourth cylinder interposed between the third and second cylinders; and a fourth variable timing mechanism adjacent the second variable valve timing mechanism and drivingly connected to the fourth camshaft through the elongate portion, the second drive means being operative to transmit drive from the layshaft to the fourth variable valve timing mechanism.

5. The camshaft drive mechanism of claim 4 wherein each variable valve timing mechanism comprises a respective rotatable driving member arranged to be driven by the respective drive means and a respective output member arranged to drive the respective camshaft, each driving member having an axis of rotation which is movable relative to the axis of rotation of the respective output member to vary the valve timing.

6. The camshaft drive mechanism of claim 5 wherein each driving member is journalled in an eccentric sleeve which is rotatable in a bore in the engine to vary the valve timing.

7. The camshaft drive mechanism of claim 6 wherein the axis of each bore is offset from the axis of rotation of the respective output member.

8. The camshaft drive mechanism of claim 7 wherein said offset is substantially equal to the eccentricity of the sleeve.

9. The camshaft drive mechanism of claim 6 wherein the eccentric sleeve is common to two adjacent variable valve timing mechanisms.

10. The camshaft drive mechanism of claim 5 further comprising:

a first input member rotatable about substantially the same axis as the first and third output members and arranged to be driven by the first drive means and to transmit drive to the first and third driving members; and a second input member rotatable about substantially the same axis as the second and fourth output members and arranged to be driven by the second drive means and to transmit drive to the second and fourth driving members.

11. The camshaft drive mechanism of claim 10 wherein each variable valve timing mechanism further comprises a peg on the respective input member, and a peg on the respective output member each driving member defining a pair of diametrically opposed radially extending grooves each for driving engagement with a respective one of the pegs.

12. The camshaft drive mechanism of claim 11 wherein the output member of each of said third and fourth variable valve timing mechanisms extends through the driving member of the respective one of said first and second variable valve timing mechanisms.

13. The camshaft drive mechanism of claim 12 wherein in each of said first and second variable valve timing mechanisms the respective input member extends through an aperture in the adjacent driving member of the respective one of the third and fourth variable valve timing mechanisms.

14. The camshaft drive mechanism of claim 12 wherein the output member of each of the third and fourth variable valve timing mechanisms comprises the elongate portion of the respective camshaft.

15. The camshaft drive mechanism of claim 5 wherein each output member is on the respective camshaft.

16. In an internal combustion engine having an engine block which defines at least one cylinder, inlet and exhaust valves for the cylinder and a crankshaft, a camshaft drive mechanism comprising:

a camshaft for operating one of said valves for the cylinder; and a variable valve timing mechanism drivingly connecting the crankshaft to the camshaft and comprising a rotatable driving member drivingly connected to the crankshaft, an output member arranged to drive the camshaft and a rotatable eccentric sleeve providing a journal for the driving member and being rotatable in a bore of the engine block to move the axis of rotation of the driving member, the axis of said bore being offset from the axis of rotation of the output member by a fixed amount.

17. The camshaft drive mechanism of claim 16 wherein said offset is substantially equal to the eccentricity of the eccentric sleeve.

18. The camshaft drive mechanism of claim 17 wherein the axis of rotation of the driving member substantially coincides with the axis of rotation of the output member at one operational rotary position of the eccentric sleeve.

19. The camshaft drive mechanism of claim 16 further comprising an input member rotatable about substantially the same axis as the output member and arranged to be driven by the crankshaft and to transmit drive to the driving member.

20. The camshaft drive mechanism of claim 19 wherein the variable valve timing mechanism further comprises a peg on the input member and a peg on the output member, the driving member defining a pair of diametrically opposed radially extending grooves each for driving engagement with a respective one of the pegs.

21. The camshaft drive mechanism of claim 16 wherein the output member is on the camshaft.

22. In an internal combustion engine having an engine block which defines at least first and second cylinders arranged in line, a first group of valves comprising the inlet valves for each cylinder and a second group of valves comprising the exhaust valves for each cylinder and a crankshaft, a camshaft drive mechanism comprising:

first and second camshafts extending parallel to the crankshaft for operating one of said groups of valves for the first and second cylinders respectively, the second inlet camshaft having an elongate portion extending coaxially through the first inlet camshaft;

a first variable valve timing mechanism arranged to transmit drive from the crankshaft to the first camshaft;

a second variable valve timing mechanism arranged to transmit drive from the crankshaft to the second camshaft through the elongate portion; and each variable valve timing mechanism comprising a rotatable driving member arranged to be driven by the crankshaft and an output member arranged to drive the respective camshaft and rotatable on a common axis of rotation, each driving member having an axis of rotation which is movable relative to the axis of rotation of the output members to vary the valve timing, and an eccentric sleeve which provides a journal for the driving member and which is rotatable in a bore in the engine block to vary the valve timing.

23. The camshaft drive mechanism of claim 22 wherein the axis of each bore is offset from the axis of rotation of the output members.

24. The camshaft drive mechanism of claim 23 wherein said offset is substantially equal to the eccentricity of the sleeve.

25. The camshaft drive mechanism of claim 24 wherein the eccentric sleeve is common to the first and second variable valve timing mechanisms.

26. The camshaft drive mechanism of claim 22 further comprising an input member rotatable about substantially the same axis as the output members and arranged to be driven by the crankshaft and to transmit drive to the driving members.

27. The camshaft drive mechanism of claim 26, wherein each variable valve timing mechanism further comprises a respective one of a pair of pegs on the input member and a peg on the respective output member, each driving member defining a pair of diametrically opposed radial grooves each for driving engagement with a respective one of the pegs.

28. The camshaft drive mechanism of claim 27, wherein the output member of the second variable valve timing mechanism extends through the driving member of the first variable valve timing mechanism.

29. The camshaft drive mechanism of claim 28 wherein the input member of the first variable valve timing mechanism extends through an aperture in the driving member of the second variable valve timing mechanism.

30. The camshaft drive mechanism of claim 22 wherein each output member is on the respective camshaft.

31. The camshaft drive mechanism of claim 30 wherein the driving member of the second variable valve timing mechanism comprises the elongate portion of the second camshaft.

* * * * *